US008196762B2

(12) United States Patent
Smerecky

(10) Patent No.: US 8,196,762 B2
(45) Date of Patent: Jun. 12, 2012

(54) KNUCKLE FORMED WITHOUT A FINGER CORE

(75) Inventor: Jerry R. Smerecky, Roselle, IL (US)

(73) Assignee: Bedloe Industries LLC, Wilmington, DE (US)

( * ) Notice: Subject to any disclaimer, the term of this patent is extended or adjusted under 35 U.S.C. 154(b) by 120 days.

(21) Appl. No.: 12/471,053

(22) Filed: May 22, 2009

(65) Prior Publication Data

US 2009/0294395 A1 Dec. 3, 2009

Related U.S. Application Data

(60) Provisional application No. 61/055,891, filed on May 23, 2008, provisional application No. 61/055,460, filed on May 23, 2008.

(51) Int. Cl.
*B61G 3/00* (2006.01)

(52) U.S. Cl. ..... 213/155; 213/75 R; 164/137

(58) Field of Classification Search ..... 213/75 R; 164/137, 340, 369–370
See application file for complete search history.

(56) References Cited

U.S. PATENT DOCUMENTS

| | | | |
|---|---|---|---|
| 450,947 | A | 4/1891 | Barnes |
| 491,174 | A | 2/1893 | Hazlehurst et al. |
| 892,563 | A | 7/1908 | Starbird |
| 1,346,224 | A | 7/1920 | McCormick |
| 1,382,530 | A | 6/1921 | Murphy |
| 1,638,885 | A | 8/1927 | Shea |
| 1,758,235 | A | 5/1930 | Nash |
| 1,932,440 | A | 10/1933 | Bazeley |
| 1,966,765 | A | 7/1934 | Murphy |
| 2,039,086 | A | 4/1936 | Kinne |
| 2,088,135 | A | 7/1937 | Johnson et al. |
| 2,350,470 | A | 6/1944 | Metzger |
| 2,617,540 | A | 11/1952 | Metzger |

(Continued)

FOREIGN PATENT DOCUMENTS

| | | | |
|---|---|---|---|
| BE | 524450 | A | 5/1954 |

(Continued)

OTHER PUBLICATIONS

International Search Report for International Application No. PCT/US2009/003154, dated Sep. 3, 2009, 3 pages.

(Continued)

*Primary Examiner* — S. Joseph Morano
*Assistant Examiner* — Jason C Smith
(74) *Attorney, Agent, or Firm* — Nathan O. Greene; Brinks Hofer Gilson & Lione

(57) ABSTRACT

A method for manufacturing a railcar coupler knuckle includes providing a cope mold portion and a drag mold portion, the cope and drag mold portions having internal walls defining at least in part perimeter boundaries of a coupler knuckle mold cavity, wherein the mold cavity includes a finger section; positioning at least one internal core within either the cope mold portion or the drag mold portion, the at least one internal core configured to define a kidney cavity and a pivot pin cavity within a coupler knuckle; closing the cope and drag mold portions with the single core therebetween; and at least partially filling the mold cavity with a molten alloy, the molten alloy solidifying after filling to form the coupler knuckle, wherein the at least one core defines the kidney and pivot pin cavities, and the finger section of the mold cavity defines at least one finger cavity of the coupler knuckle.

9 Claims, 7 Drawing Sheets

U.S. PATENT DOCUMENTS 2,688,412 A * 9/1954 Kulieke ..... 213/155
2,709,007 A 5/1955 Metzger
2,760,652 A 8/1956 Blattner
2,909,293 A 10/1959 Metzger
2,948,414 A 8/1960 Metzger
2,959,299 A 11/1960 Metzger
3,121,498 A 2/1964 Sudeck
3,168,202 A 2/1965 Cope
3,206,039 A 9/1965 Metzger
3,572,518 A 3/1971 Wisler
3,604,569 A 9/1971 Kulieke
3,613,902 A 10/1971 Altherr
3,627,145 A 12/1971 Altherr
3,635,356 A 1/1972 Shramovich
3,635,358 A 1/1972 Altherr
3,637,089 A 1/1972 Jwuc et al.
3,640,402 A 2/1972 Altherr et al.
3,670,901 A 6/1972 Metzger
3,675,787 A 7/1972 Krauskopf
3,698,570 A 10/1972 Metzger
3,698,571 A 10/1972 Hawthorne
3,717,261 A 2/1973 DePenti
3,722,708 A 3/1973 Ion et al.
3,735,877 A 5/1973 Bossong
3,767,062 A 10/1973 Holibaugh
3,779,397 A 12/1973 DePenti
3,833,131 A 9/1974 Altherr
3,850,311 A 11/1974 Kaufhold
3,850,312 A 11/1974 Baker, Sr.
3,853,228 A 12/1974 Metzger
3,854,599 A 12/1974 Day et al.
3,856,154 A 12/1974 DePenti
3,856,155 A 12/1974 Altherr
3,856,156 A 12/1974 Metzger
3,857,495 A 12/1974 Kaufhold
3,858,729 A 1/1975 Altherr
3,860,121 A 1/1975 Snell
3,872,978 A 3/1975 Altherr
3,881,602 A 5/1975 Altherr et al.
3,923,164 A 12/1975 Dalton
3,971,479 A 7/1976 DePenti
3,972,421 A 8/1976 DePenti
RE29,011 E 10/1976 Altherr
3,998,337 A 12/1976 Altherr
4,024,958 A * 5/1977 Kaufhold ..... 213/152
4,051,954 A 10/1977 Roberts
4,064,998 A 12/1977 Dilg et al.
4,081,082 A 3/1978 Scherrer et al.
4,084,704 A 4/1978 Metzger
4,084,705 A 4/1978 Oshinsky et al.
4,090,614 A 5/1978 Altherr et al.
4,090,615 A 5/1978 Martin
4,093,079 A 6/1978 Cope
4,119,209 A 10/1978 Jwuc
4,129,219 A 12/1978 Polanin
4,135,629 A 1/1979 Dilg et al.
4,143,701 A 3/1979 Oshinsky et al.
4,146,143 A 3/1979 Schelle
4,172,530 A 10/1979 Altherr et al.
4,206,849 A * 6/1980 Kaim ..... 213/151
4,230,228 A 10/1980 Kaim
4,245,747 A 1/1981 Roberts
4,258,628 A 3/1981 Altherr
4,267,935 A 5/1981 Dilg
4,287,834 A 9/1981 Zehnder et al.
4,316,549 A 2/1982 Klimowicz
4,333,576 A 6/1982 Kaim
4,363,414 A 12/1982 Kaim
4,391,380 A 7/1983 Hoose
4,398,641 A 8/1983 Klimowicz
4,426,012 A 1/1984 Adams, III et al.
4,438,854 A 3/1984 Baughman et al.
4,438,855 A 3/1984 Altherr
4,445,617 A 5/1984 Elliott
4,452,299 A 6/1984 Gruber et al.
4,466,546 A 8/1984 Altherr et al.
4,474,732 A 10/1984 Lynn
4,480,758 A 11/1984 Hurt et al.
4,585,133 A 4/1986 Cope
4,595,109 A 6/1986 McClurg
4,605,133 A * 8/1986 Altherr ..... 213/155
4,637,518 A 1/1987 Hanula
4,640,422 A 2/1987 Elliott
4,645,085 A 2/1987 Hanula et al.
4,706,826 A 11/1987 Elliott et al.
4,776,474 A 10/1988 Terlecky et al.
4,811,854 A * 3/1989 Elliott ..... 213/155
4,848,611 A 7/1989 Terlecky et al.
4,927,035 A 5/1990 Geng et al.
4,976,362 A 12/1990 Kaufhold
4,976,363 A 12/1990 Altherr
4,982,781 A 1/1991 Carpenter et al.
4,984,696 A 1/1991 Altherr
5,050,751 A 9/1991 Thrift et al.
5,139,161 A 8/1992 Long
5,145,076 A 9/1992 Murphy et al.
5,285,911 A 2/1994 Altherr
5,305,899 A 4/1994 Kaufhold
5,312,007 A 5/1994 Kaufhold et al.
5,415,304 A 5/1995 Hanes et al.
5,424,376 A 6/1995 Chang et al.
5,427,257 A 6/1995 Hanes et al.
5,482,675 A 1/1996 Shotwell et al.
D369,756 S 5/1996 Noel
5,582,307 A * 12/1996 Hawthorne et al. ..... 213/109
5,630,519 A 5/1997 Burke et al.
5,833,086 A 11/1998 Kaufhold
5,878,897 A 3/1999 Lazzaro et al.
5,927,522 A 7/1999 Carifa
5,954,212 A * 9/1999 Beatty et al. ..... 213/155
6,005,021 A 12/1999 Chen et al.
6,062,406 A 5/2000 Duncan
6,129,227 A * 10/2000 Openchowski et al. ..... 213/111
6,148,733 A 11/2000 Gagliardino
6,206,215 B1 3/2001 Maa
6,237,785 B1 5/2001 Daugherty, Jr.
6,360,906 B1 3/2002 Kaufhold et al.
6,446,820 B1 9/2002 Barker et al.
6,488,163 B1 12/2002 Wurzer et al.
6,681,943 B2 1/2004 Barker et al.
6,758,919 B2 7/2004 Milligan
6,783,610 B2 8/2004 Shirley et al.
6,796,448 B1 9/2004 Wilt et al.
6,944,925 B2 9/2005 Brueckert et al.
7,020,977 B2 4/2006 Brueckert et al.
7,059,062 B2 6/2006 Brueckert et al.
7,143,522 B2 12/2006 Brueckert et al.
7,171,734 B2 2/2007 Brueckert et al.
7,171,758 B2 2/2007 Brueckert et al.
7,302,994 B2 * 12/2007 Mautino et al. ..... 164/137
7,337,826 B2 3/2008 Mautino et al.
7,360,318 B2 4/2008 Brueckert et al.
2003/0127412 A1 7/2003 Mautino et al.
2004/0173555 A1 9/2004 Wilt et al.
2005/0160581 A1 7/2005 Brueckert et al.
2005/0160582 A1 7/2005 Brueckert et al.
2005/0160584 A1 7/2005 Brueckert et al.
2005/0184021 A1 8/2005 Mautino et al.
2006/0113267 A1 6/2006 Mautino et al.
2007/0084818 A1 4/2007 Brabb et al.
2007/0125510 A1 * 6/2007 Mautino et al. ..... 164/137
2007/0130773 A1 6/2007 Brueckert et al.
2008/0083690 A1 * 4/2008 Mautino et al. ..... 213/152
2009/0289023 A1 * 11/2009 Marchese et al. ..... 213/155
2009/0294395 A1 * 12/2009 Smerecky ..... 213/155

FOREIGN PATENT DOCUMENTS

CA 485408 A 8/1952
CA 510469 A 3/1955
CA 753964 A 3/1957
CA 540837 A 5/1957
CA 547137 A 10/1957
CA 905353 A 7/1972
CA 1022116 A1 12/1977
CA 1034085 A1 7/1978
CA 1039683 A1 10/1978
CA 1041050 A1 10/1978

| | | | |
|---|---|---|---|
| CA | 1045085 | A1 | 12/1978 |
| CA | 1079234 | A1 | 6/1980 |
| CA | 1087135 | A1 | 10/1980 |
| CA | 1089808 | A1 | 11/1980 |
| CA | 1093021 | A1 | 1/1981 |
| CA | 1098869 | A1 | 4/1981 |
| CA | 1108560 | A1 | 9/1981 |
| CA | 1195660 | A1 | 10/1985 |
| CA | 1226244 | A1 | 9/1987 |
| CA | 1251170 | A1 | 3/1989 |
| CA | 2027987 | A1 | 5/1991 |
| CA | 2054390 | A1 | 5/1992 |
| CA | 2171030 | A1 | 11/1996 |
| CA | 2260658 | A1 | 9/1999 |
| CA | 2395875 | A1 | 7/2003 |
| CA | 2573306 | A1 | 2/2006 |
| EP | 1531018 | A1 | 5/2005 |
| GB | 185657 | A | 9/1922 |
| GB | 221691 | A | 9/1924 |
| GB | 326575 | A | 3/1930 |
| GB | 355247 | A | 8/1931 |
| GB | 743098 | A | 1/1956 |
| GB | 902971 | A | 8/1962 |
| GB | 1477368 | A | 6/1977 |
| GB | 2300611 | A | 11/1996 |
| WO | WO 01/81024 | A1 | 11/2001 |
| WO | WO 2006/017412 | A1 | 2/2006 |
| WO | WO 2009/142746 | A1 | 11/2009 |
| WO | WO 2009/142747 | A1 | 11/2009 |
| WO | WO 2009/142748 | A1 | 11/2009 |
| WO | WO 2009/142749 | A1 | 11/2009 |
| WO | WO 2009/142750 | A1 | 11/2009 |
| WO | WO 2009/142757 | A1 | 11/2009 |
| WO | WO 2011/084992 | A1 | 7/2011 |

OTHER PUBLICATIONS

International Preliminary Report on Patentability for International Application No. PCT/US2009/003154, dated Nov. 23, 2010, 8 pages.
International Search Report for International Application No. PCT/US2009/003155, dated Aug. 27, 2009, 3 pages.
International Preliminary Report on Patentability for International Application No. PCT/US2009/003155, dated Nov. 23, 2010, 7 pages.
International Search Report for International Application No. PCT/US2009/003157, dated Sep. 10, 2009, 3 pages.
International Preliminary Report on Patentability for International Application No. PCT/US2009/003157, dated Nov. 23, 2010, 8 pages.
International Search Report for International Application No. PCT/US2009/003158, dated Aug. 27, 2009, 2 pages.
International Preliminary Report on Patentability for International Application No. PCT/US2009/003158, dated Nov. 23, 2010, 9 pages.
International Search Report for International Application No. PCT/US2009/003159, dated Aug. 31, 2009, 3 pages.
International Preliminary Report on Patentability for International Application No. PCT/US2009/003159, dated Nov. 23, 2010, 8 pages.
International Search Report for International Application No. PCT/US2009/003170, dated Sep. 1, 2009, 3 pages.
International Preliminary Report on Patentability for International Application No. PCT/US2009/003170, dated Nov. 23, 2010, 9 pages.
International Search Report for International Application No. PCT/US2011/020207, dated Apr. 15, 2011, 2 pages.
Armstrong Mold Corporation, "Precision Air-Set Sand Casting Process," retrieved Oct. 7, 2009, from http://www.armstrongmold.com/pages/airset.html, 2 pages.
Bernier Cast Metals Inc., "Air-Set (No Bake) Process," retrieved Oct. 7, 2009, from http://www.bernierinc.com/AirSet.html, 1 page.
Bernier Cast Metals Inc., "Green Sand Molding," retrieved Oct. 7, 2009, from http://www.bernierinc.com/GreenSandMolding.html, 1 page.
Butler Foundry, "Air Set Casting," retrieved Oct. 7, 2009, from http://www.foundrycasting.co.uk/air-set-casting.html, 2 pages.
Custom PartNet, "Sand Casting," retrieved Oct. 7,2009, from http://www.custompartnet.com/wu/SandCasting, 7 pages.
SCRATA Specifications Committee, "Comparators for the Definition of Surface Quality of Steel Castings," publication date unknown, 32 pages.
SFSA Supplement 3, "Dimensional Capabilities of Steel Castings," retrieved Jan. 12, 2010, from www.sfsa.org/sfsa/pubs/hbk/s3.pdf, 33 pages.
Wikipedia, "Chill (casting)," retrieved Oct. 7, 2009, from http://en.wikipedia.org/wiki/Chill_(foundry), 2 pages.
Wikipedia, "Cope and drag," retrieved Oct. 7,2009, from http://en.wikipedia.org/wiki/Cope_and_drag, 1 page.
Wikipedia, "Flask (casting)," retrieved Oct. 7,2009, from http://en.wikipedia.org/wiki/Casting_flask, 1 page.
Wikipedia, "Molding sand," retrieved Oct. 7, 2009, from http://en.wikipedia.org/wiki/Molding_sand, 1 page.
Wikipedia, "No bake mold casting," retrieved Oct. 7, 2009, from http://en.wikipedia.org/wiki/No_bake_mold_casting, 2 pages.
Wikipedia, "Sand Casting," retrieved Oct. 7, 2009, from http://en.wikipedia.org/wiki/Sand_casting, 10 pages.
Transactions of the American Foundrymen's Society, Proceedings of the Ninety-first Annual Meeting, Apr. 5-10, 1987. vol. 95, 21 pages.
Unknown Author, "A.R.A. Type "E" Coupler," Railway Mechanical Engineer, May 1932, pp. 207-208.
Unknown Author, "Report on Couplers and Draft Gears," Railway Mechanical Engineer, Jul. 1933, pp. 243-244.
Unknown Author, "Steel Castings Handbook," 6th Edition, Steel Founders' Society of America, © 1995, 3 pages.
Walton, Charles F. et al., "Iron Castings Handbook," Iron Castings Society, Inc., © 1981, 5 pages.
Office Action from co-pending U.S. Appl. No. 12/471,029, dated Feb. 16, 2011, 9 pages.
Office Action from co-pending U.S. Appl. No. 12/470,915, dated Feb. 16, 2011, 8 pages.
Office Action from co-pending U.S. Appl. No. 12/470,883, dated Mar. 2, 2011, 8 pages.
Office Action from co-pending U.S. Appl. No. 12/471,110, dated Mar. 17, 2011, 11 pages.
Office Action from co-pending U.S. Appl. No. 12/471,136, dated Jun. 21, 2011, 9 pages.
Office Action from co-pending U.S. Appl. No. 12/685,346, dated Aug. 16, 2011, 7 pages.
Office Action from co-pending U.S. Appl. No. 12/470,883, dated Sep. 21, 2011, 8 pages.
Specification and File Wrapper for U.S. Appl. No. 12/470,883.
Specification and File Wrapper for U.S. Appl. No. 12/470,915.
Specification and File Wrapper for U.S. Appl. No. 12/471,029.
Specification and File Wrapper for U.S. Appl. No. 12/471,110.
Specification and File Wrapper for U.S. Appl. No. 12/471,136.
Specification and File Wrapper for U.S. Appl. No. 12/685,346.

* cited by examiner

SECTION A-A

KNUCKLE FORMED WITHOUT A FINGER CORE

RELATED APPLICATIONS

This application claims priority to U.S. provisional application Ser. No. 61/055,891 filed May 22, 2008, and Ser. No. 61/055,460 filed May 23, 2008, the disclosures of which are incorporated by reference herein in their entirety.

BACKGROUND

1. Technical Field

The present embodiments relate generally to the field of railroad couplers, and more specifically, to the manufacturing of a railway coupler knuckle where the core for the front portion of the knuckle has been eliminated.

2. Related Art

Railcar couplers are disposed at each end of a railway car to enable joining one end of such railway car to an adjacently disposed end of another railway car. The engageable portion of each of these couplers is known in the railway art as a knuckle.

Typically, a knuckle is manufactured with three cores, commonly referred to as a finger core in the front portion of the knuckle, pivot pin core in the center of the knuckle, and a kidney core at the rear of a knuckle. The finger core and kidney core reduce the weight of the knuckle. Still, knuckles can weigh about 80 pounds, and must be carried from the locomotive at least part of the length of the train during replacement. This distance can be anywhere from 25 up to 100 or more railroad cars in length.

Coupler knuckles are generally manufactured from cast steel using a mold and the three cores. During the casting process itself, the interrelationship of the mold and three cores disposed within the mold are critical to producing a satisfactory railway freight car coupler knuckle. Many knuckles fail from internal and/or external inconsistencies in the metal through the knuckle. If one or more cores move during the casting process, then some knuckle walls may end up thinner than others resulting in offset loading and increased failure risk during use of the knuckle.

Furthermore, multiple thin ribs have been located within a front face section associated with a finger cavity at the front of the knuckle. These multiple, thin ribs are known to be a source of premature failure of the couple knuckles so designed.

SUMMARY OF INVENTION

In a first embodiment, a method for manufacturing a railcar coupler knuckle includes providing a cope mold portion and a drag mold portion, the cope and drag mold portions having internal walls defining at least in part perimeter boundaries of a coupler knuckle mold cavity, wherein the mold cavity includes a finger section; positioning at least one internal core within either the cope mold portion or the drag mold portion, the at least one internal core configured to define a kidney cavity and a pivot pin cavity within a coupler knuckle; closing the cope and drag mold portions with the single core therebetween; and at least partially filling the mold cavity with a molten alloy, the molten alloy solidifying after filling to form the coupler knuckle, wherein the at least one core defines the kidney and pivot pin cavities, and the finger section of the mold cavity defines at least one finger cavity of the coupler knuckle.

In a second embodiment, a method for manufacturing a railcar coupler knuckle, comprises the steps of providing a cope mold portion and a drag mold portion, the cope and drag mold portions having internal walls defining at least in part perimeter boundaries of a coupler knuckle mold cavity, positioning a single internal core within either the cope mold portion or the drag mold portion, the single internal core configured to define a kidney cavity and a pivot pin cavity within a coupler knuckle, closing the cope and drag mold portions with the single core therebetween, and at least partially filling the mold cavity with a molten alloy, the molten alloy solidifying after filling to form the coupler knuckle wherein the single core defines the kidney and pivot pin cavities of the coupler knuckle.

In a third embodiment, a railcar coupler knuckle, comprises a tail section, a hub section, and a nose section, the tail, hub, and nose sections defining internal cavities comprising (i) a kidney cavity, (ii) a pivot pin cavity, and (ii) a finger cavity, the kidney and pivot pin cavities formed using at least one internal core during manufacturing of the coupler knuckle and the finger cavity formed from a finger section of cope and drag mold portions during manufacturing of the coupler knuckle.

BRIEF DESCRIPTION OF THE DRAWINGS

The system may be better understood with reference to the following drawings and description. The components in the figures are not necessarily to scale, emphasis instead being placed upon illustrating the principles of the invention. Moreover, in the figures, like-referenced numerals designate corresponding parts throughout the different views.

DETAILED DESCRIPTION

In some cases, well known structures, materials, or operations are not shown or described in detail. Furthermore, the described features, structures, or characteristics may be combined in any suitable manner in one or more embodiments. It will also be readily understood that the components of the embodiments as generally described and illustrated in the Figures herein could be arranged and designed in a wide variety of different configurations.

Figure 1:
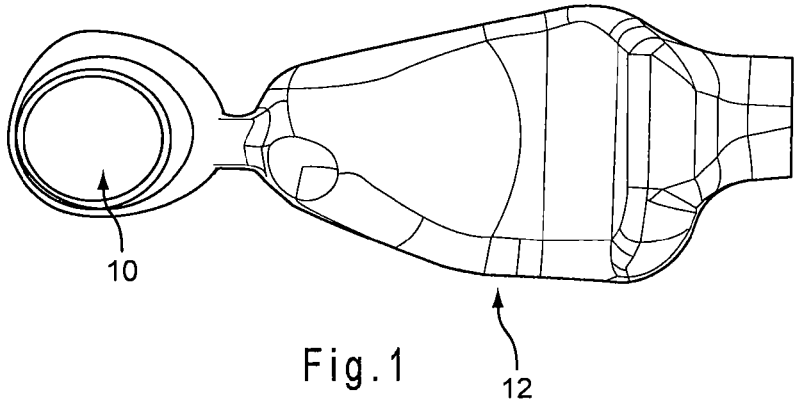
FIG. 1 is a top view of the knuckle core used to define a pivot pin cavity and kidney cavity.
Figure 2:
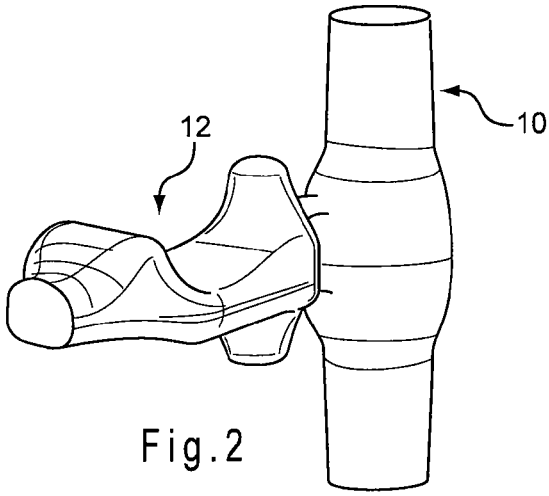
FIGS. 2 and 3 are perspective views of the knuckle core of FIG. 1.
Figure 3:
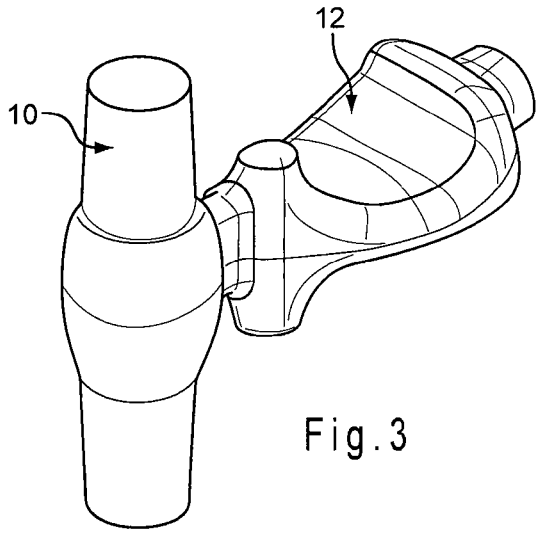
Figure 4:
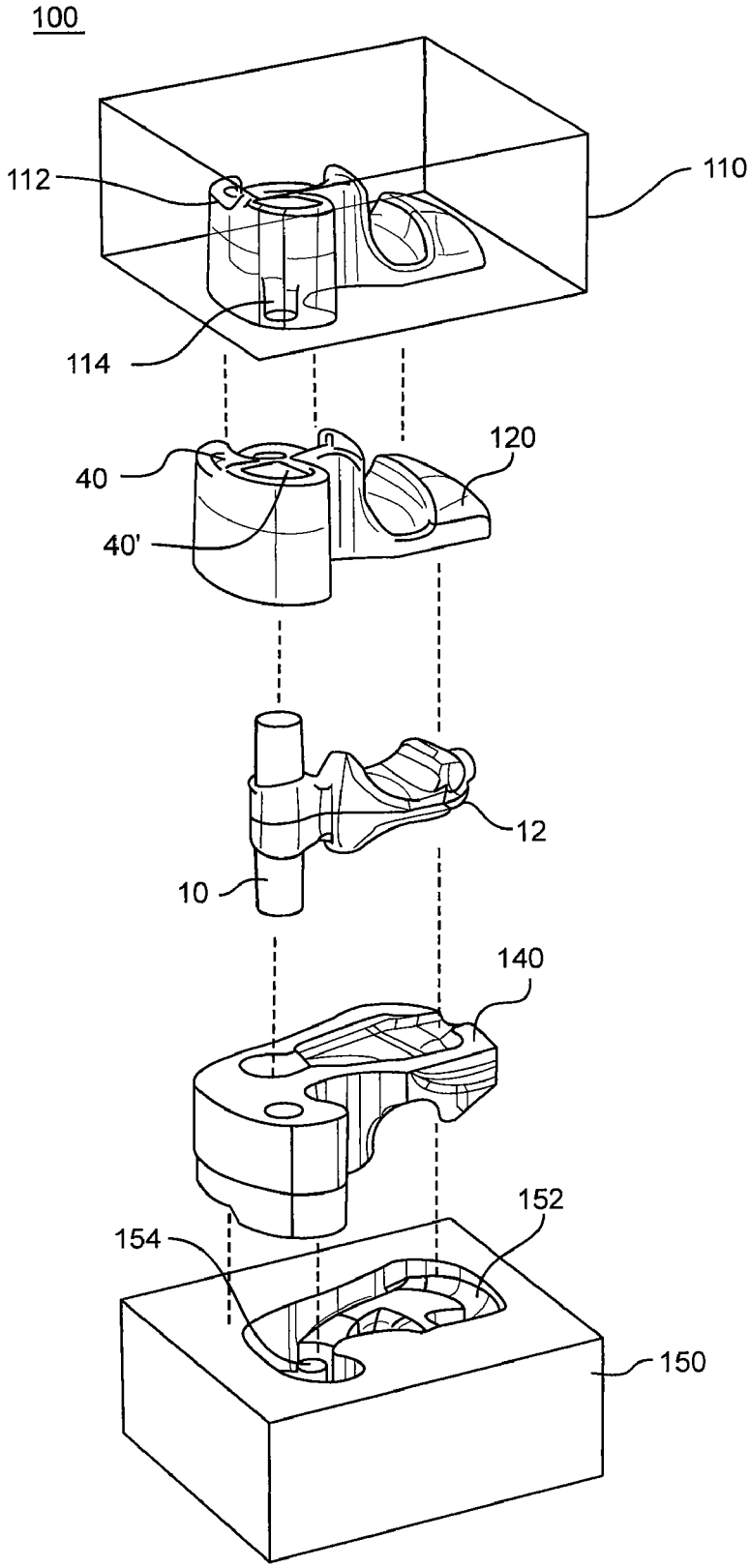
FIG. 4 is a schematic illustration of a coupler knuckle manufacturing assembly for manufacturing a coupler knuckle using the knuckle core of FIGS. 1-3.

Referring to FIGS. 1-3, the present embodiments of a railroad coupler knuckle combines a pivot pin core 10 and a kidney core 12 into a single core used in manufacturing the coupler knuckle. No finger core is required. As can be seen in FIG. 4, at least one finger cavity 40 (and/or 40') is formed from portions of the cope and drag molds during the molding process, thus eliminating the need for another core or portion of a core that would be required to form the finger cavity. The at least one finger cavity 40 helps to reduce the weight of the coupler knuckle. The advantage of manufacturing the coupler knuckle without use of a finger core includes use of fewer cores, or if one core is used, the single core requires less sand. Reduction of the number of cores or of the overall size of a single core reduces the manufacturing cost.

Figure 5:
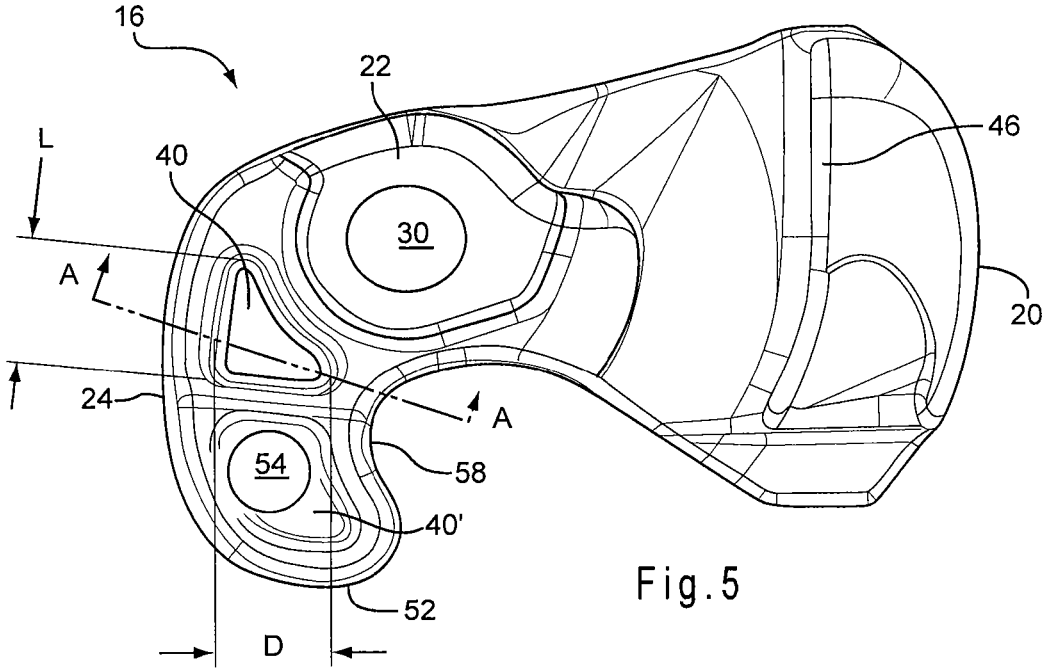
FIG. 5 is a top view of a coupler knuckle molded using the coupler knuckle manufacturing assembly of FIG. 4 and knuckle core of FIGS. 1-3, indicating a cross section view along line A-A.
Figure 6:
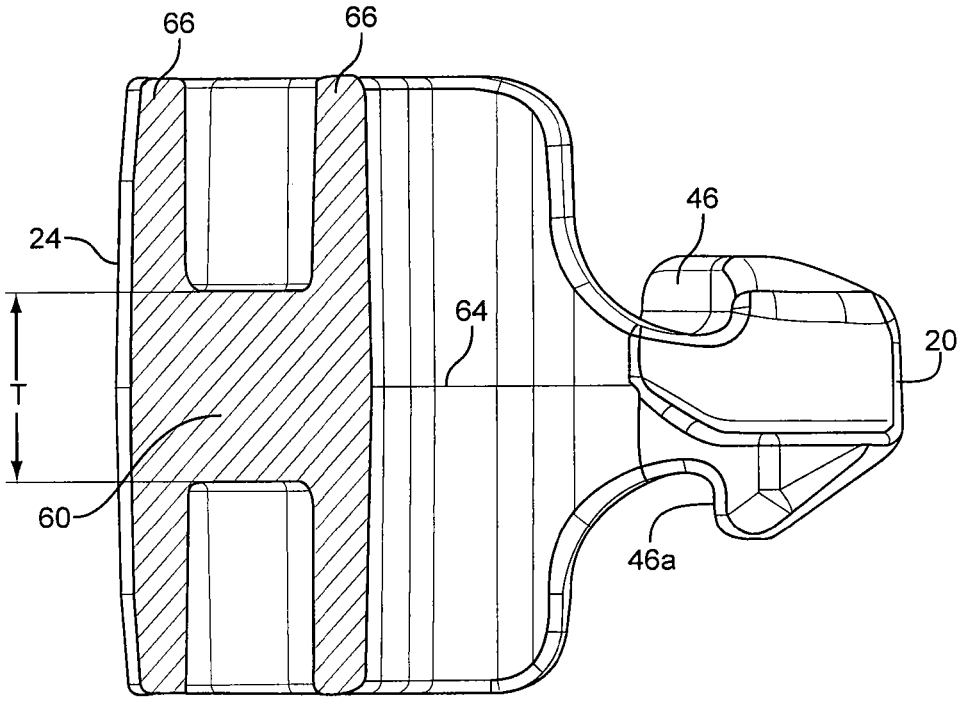
FIG. 6 is the cross section view along line A-A of the knuckle of FIG. 5.

More specifically, FIG. 4 is a schematic illustration of a coupler knuckle manufacturing assembly 100 for manufacturing a coupler knuckle (16 in FIGS. 5-6). The knuckle manufacturing assembly 100 includes a cope mold section 110, an upper section 120 of the coupler knuckle, the single pivot pin and kidney core 10, 12 used in the manufacturing process, a lower section 140 of the coupler knuckle, and a drag mold section 150. Of course, two separate cores could be used, a pivot pin core 10 and a kidney core 12, in lieu of the single pivot pin and kidney core 10, 12.

The cope mold section 110 and the drag mold section 150 include mold cavities 112 and 152, respectively, into which a molten alloy is poured to cast the coupler knuckle. The mold cavities 112 and 152 are configured to correspond to the desired external surfaces of the coupler knuckle to be manufactured using cope and drag mold sections 110 and 150. In the present embodiments, a cope finger section 114 of the cope mold cavity 112 and a corresponding drag finger section 154 of the drag mold cavity 152 form the at least one finger cavity 40 during the molding process. Additionally, a cylindrical flag hole (54 in FIG. 5) may be formed within the at least one finger cavity 40 by including a cylindrical pin as part of the cope and drag finger mold sections 114, 154. The cope and drag finger sections 114, 154 may be joined in the center of the mold cavities 112, 152, forming a single finger section once the cope and drag mold portions 110, 150 are closed. The single internal core 10, 12 includes pivot pin and kidney portions to form corresponding pivot pin and kidney cavities.

FIG. 5 is a top view of a coupler knuckle 16 molded using the coupler knuckle manufacturing assembly 100 of FIG. 4 and the single knuckle core 10, 12 of FIGS. 1-3. The coupler knuckle 16 includes a tail section 20, a hub section 22 and a front face section 24. The hub section 22 includes a pivot pin hole 30 formed therein for receiving a pivot pin to pivotally couple the knuckle 16 to a coupler for coupling to a railcar. The pivot pin hole 30 is formed from at least a portion of the single internal core 10, 12. The pivot pin hole 30 includes generally cylindrical sidewalls. The knuckle 16 also includes at least one finger cavity 40 in the front face section 24 created with the cope and drag finger sections 114, 154 during molding. The coupler knuckle 16 also includes a top pulling lug 46 and a bottom pulling lug 46*a* used to pull the knuckle 16 when attached to the train.

The front face section 24 includes a nose section 52, which includes a generally cylindrical flag hole 54 opening formed in an end region of the nose section 52. A pulling face portion 58 is disposed inwardly from nose section 52, at least a portion of which bears against a similar surface of a coupler knuckle of an adjacent railcar to couple the railcars together.

As shown in FIG. 6, the cope and drag finger sections 114, 154 of the cope and drag mold cavities 112, 152, respectively, are designed to create within the at least one finger cavity 40 a single, continuous, solid, uninterrupted thick rib 60 located along a horizontal centerline 64 of the knuckle 16 that passes through the pivot pin hub section 22. A pair of side fins (or walls) 66 are attached to the thick rib 60 and extend along the front face section 24.

The single, thick rib 60 replaces the multiple thin ribs of prior art knuckles, thus aiding in prevention of premature knuckle failure due to break down of the multiple thin ribs. The single, thick rib 60 may extend approximately from the flag hole 54 to the other side of the knuckle 16. In one embodiment, the depth D and length L of the cross section of the single, thick rib are approximately 1.9" and 1.7", respectively, as shown in FIGS. 5 and 6. The thickness T of the single, thick rib 60 as shown in FIG. 6 may be approximately 3.0" in one embodiment. The single, thick rib 60 transfers the draft load of the train along a direct path to the pulling lugs 46.

Figure 7:
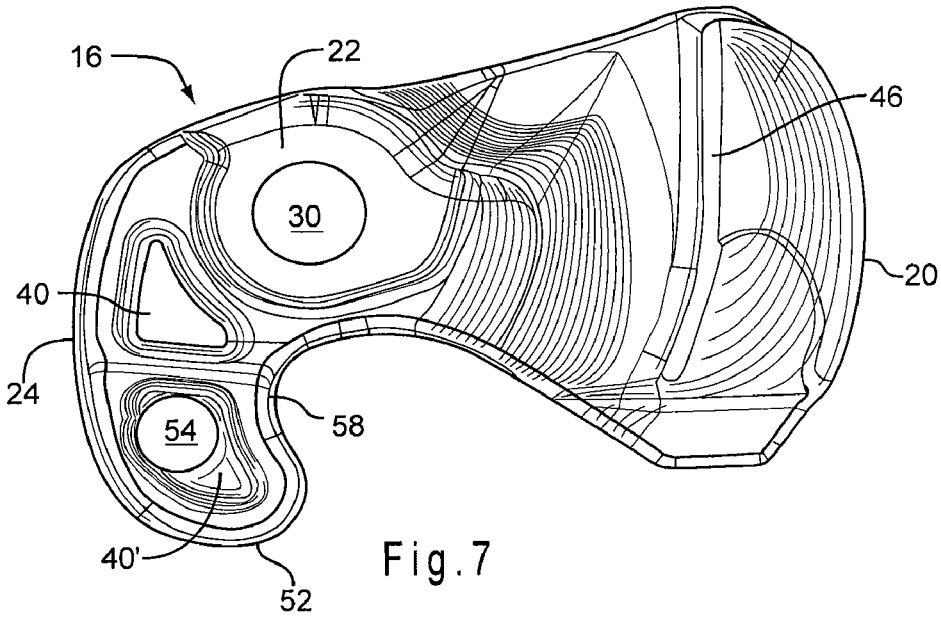
FIGS. 7 and 8 are, respectively, solid and line top views of the knuckle of FIGS. 5-6 after completion of the molding process.
Figure 8:
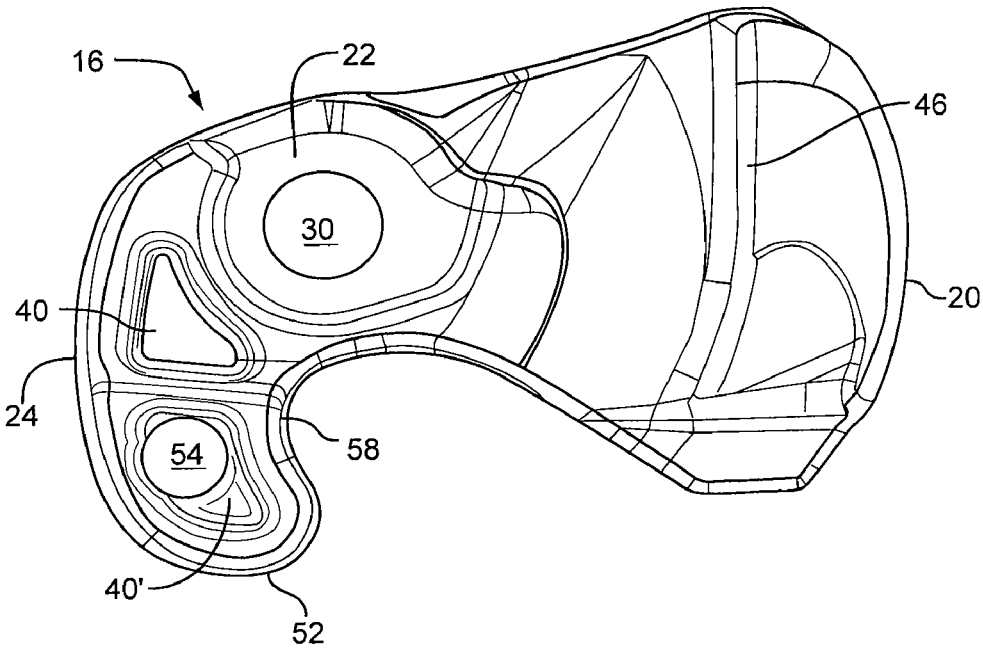
Figure 9:
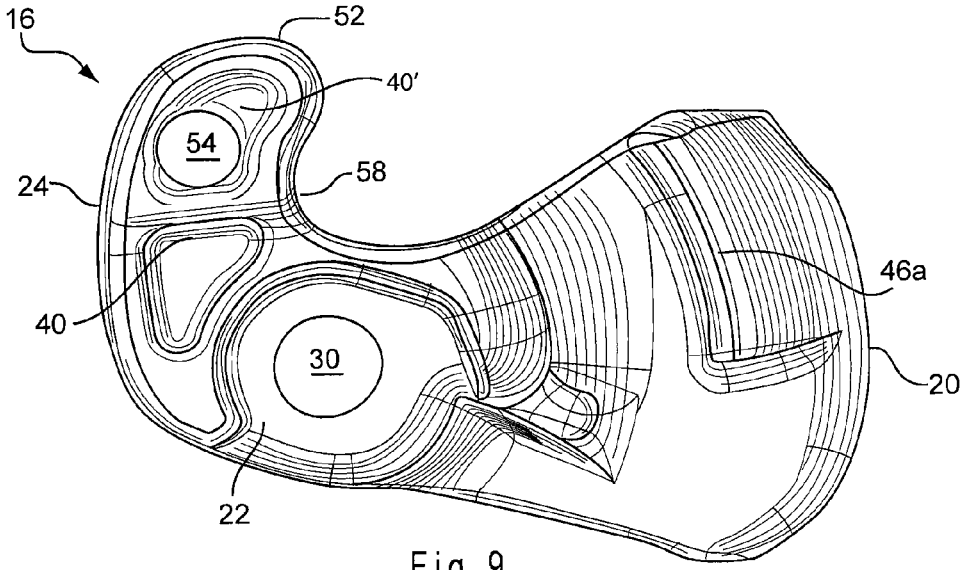
FIGS. 9 and 10 are, respectively, solid and line bottom views of the knuckle of FIGS. 5-6 after completion of the molding process.
Figure 10:
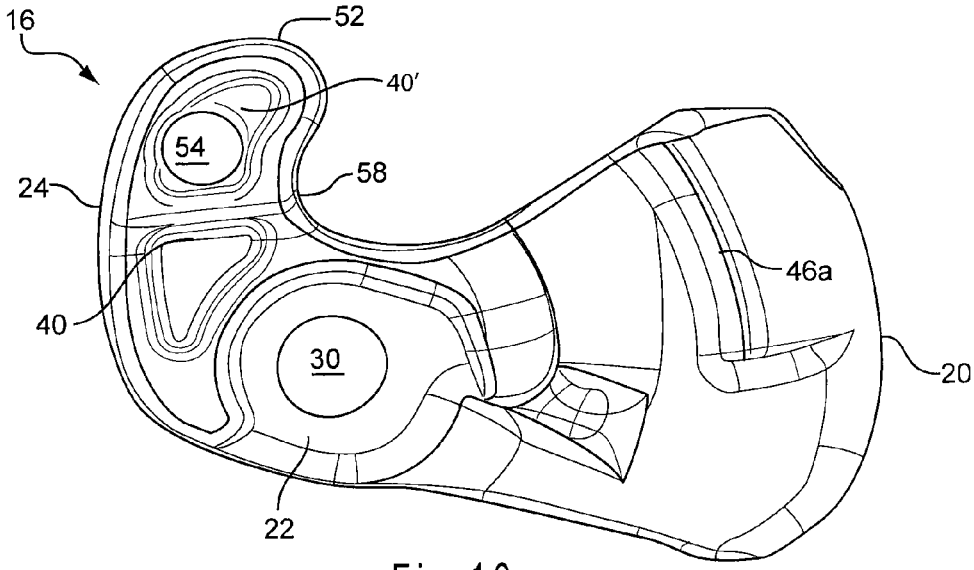

FIGS. 7 and 8 are, respectively, solid and line top views of the knuckle 16 of FIGS. 5-6 after completion of the molding process. FIGS. 9 and 10 are, respectively, solid and line bottom views of the knuckle 16 of FIGS. 5-6 after completion of the molding process. Note that in this embodiment, the knuckle 16 includes two separate finger cavities 40, 40' in each of the top and bottom thereof. One of these finger cavities 40' includes the flag hole 54, through which water may drain from the knuckle 16. In the alternative from what is shown, in another embodiment, the two separate finger cavities 40, 40' may be combined into a single, joined cavity 40.

Figure 11:
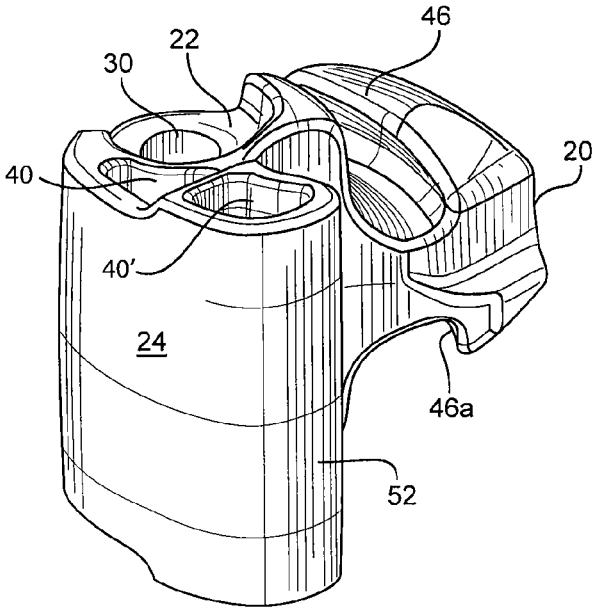
FIGS. 11 and 12 are, respectively, solid and line perspective views of the knuckle of FIGS. 4-9 after completion of the molding process.
Figure 12:
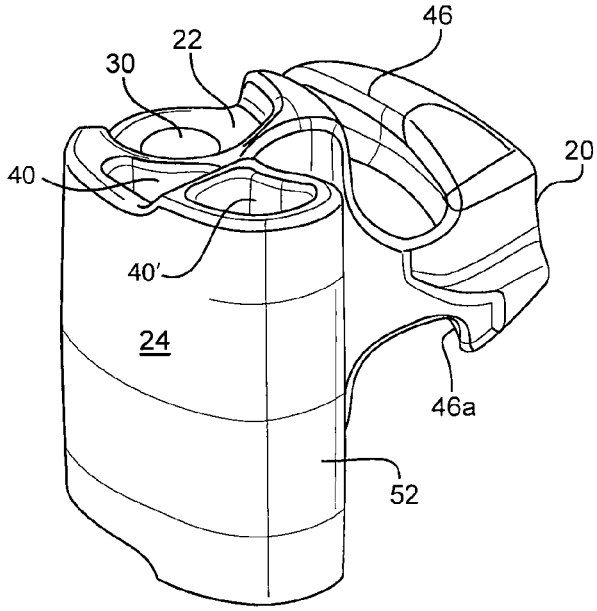

FIGS. 11 and 12 are, respectively, solid and line perspective views of the knuckle 16 of FIGS. 5-9 after completion of the molding process using the coupler knuckle manufacturing assembly 100. Note finger cavities 40, 40' formed from the cope and drag finger sections 114, 154 of the cope and drag mold cavities 112, 152 discussed with reference to the manufacturing assembly 100 of FIG. 4.

Figure 13:
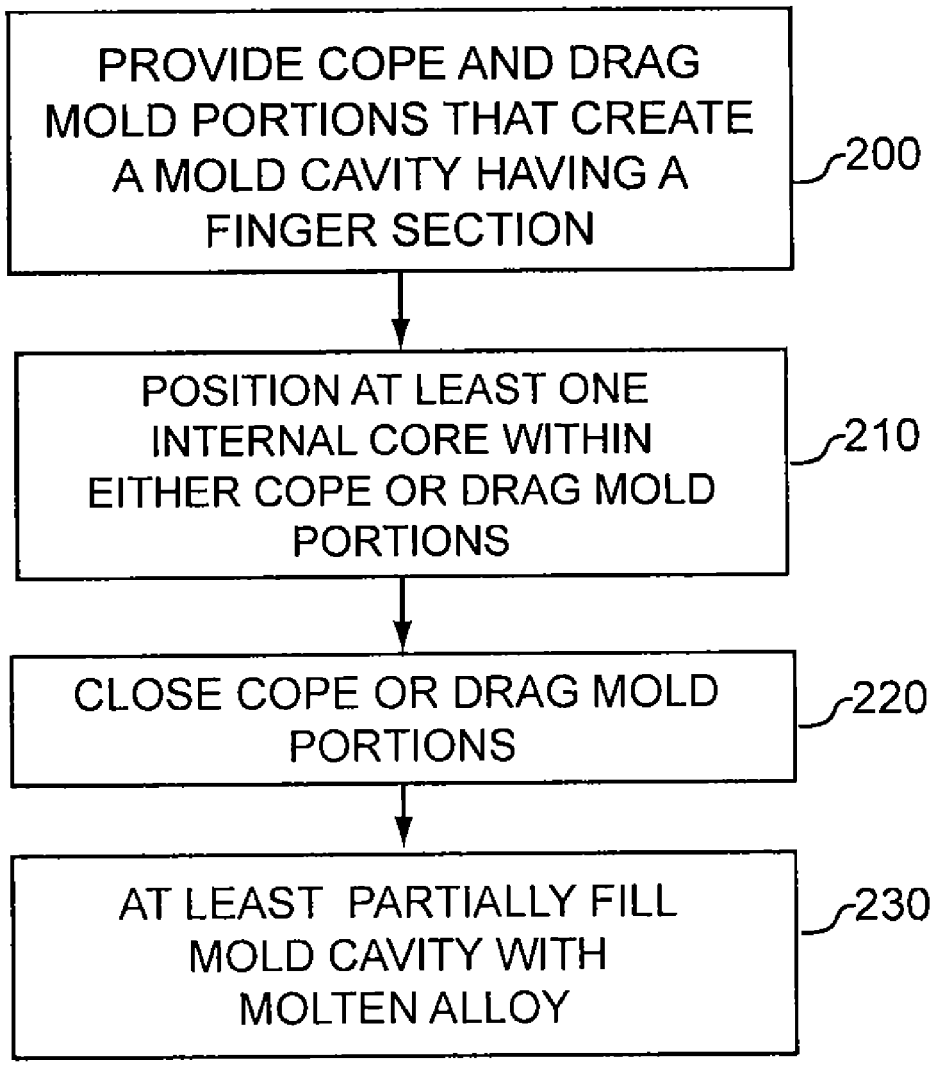
FIG. 13 is a flowchart illustrating a method for manufacturing the railcar coupler knuckle of FIGS. 5-12.

FIG. 13 is a flowchart illustrating a method for manufacturing the railcar coupler knuckle 16 of FIGS. 5-12, and which uses the coupler knuckle manufacturing assembly 100 of FIG. 4. The method begins at step 200 where cope and drag mold portions are provided that create a mold cavity, at least a part of which includes a finger section. The cope and drag mold portions may each include internal walls, formed of sand using a pattern or otherwise, that define at least in part perimeter boundaries of a coupler knuckle mold cavity. The mold cavity corresponds to the desired shape and configuration of a coupler knuckle to be cast using the cope and drag mold portions. The finger section forms at least one finger cavity of the coupler knuckle.

At step 210, at least one internal core is positioned within either the cope mold portion or the drag mold portions, wherein the at least one internal core is configured to define a kidney cavity and a pivot pin cavity within the coupler knuckle. At step 220, the cope and drag mold portions are closed with the one or two internal cores therebetween using any suitable machinery. At step 230, the mold cavity including the at least one internal core is at least partially filled, using any suitable machinery, with a molten alloy which solidifies to form the coupler knuckle. The at least one internal core defines the kidney and pivot pin cavities, and the finger section of the mold cavity defines at least one finger cavity of the coupler knuckle.

Some of the steps illustrated in FIG. 13 may be combined, modified or deleted where appropriate, and additional steps may also be added to the flowchart. Additionally, steps may be performed in any suitable order without departing from the spirit and scope of the embodiment described therein.

The terms and descriptions used herein are set forth by way of illustration only and are not meant as limitations. Those skilled in the art will recognize that many variations can be made to the details of the above-described embodiments without departing from the underlying principles of the disclosed embodiments. For example, the steps of the method need not be executed in a certain order, unless specified, although they may have been presented in that order in the disclosure. The scope of the invention should, therefore, be determined only by the following claims (and their equivalents) in which all terms are to be understood in their broadest reasonable sense unless otherwise indicated.

The invention claimed is:

1. A method for manufacturing a railcar coupler knuckle, said method comprising the steps of:

providing a cope mold portion and a drag mold portion, the cope and drag mold portions having internal walls defining at least in part perimeter boundaries of a coupler knuckle mold cavity, wherein the mold cavity defines a finger section;

positioning at least one internal core within either the cope mold portion or the drag mold portion, the at least one internal core configured to define a kidney cavity and a pivot pin cavity within a coupler knuckle;

closing the cope and drag mold portions with the single core therebetween; and at least partially filling the mold cavity with a molten alloy, the molten alloy solidifying after filling to form the coupler knuckle, wherein the at least one core defines the kidney and pivot pin cavities, and the finger section of the mold cavity defines the entirety of a finger cavity of the coupler knuckle.

2. The method of claim 1, wherein the finger section also creates a single, thick rib at a horizontal centerline of the knuckle that passes through the pivot pin cavity, wherein the single, thick rib extends approximately from a flag hole of the finger cavity to an opposite side of the knuckle from the flag hole.

3. The method of claim 2, wherein the single, thick rib comprises dimensions of about 3.0" thick, about 1.7" deep, and about 1.9" long.

4. The method of claim 1, wherein the at least one core comprises two, separate internal cores, a first for forming the pivot pin cavity and a second for forming the kidney cavity.

5. The method of claim 1, wherein the at least one internal core comprises a single, combined pivot pin and kidney core.

6. A method for manufacturing a railcar coupler knuckle, said method comprising the steps of:

providing a cope mold portion and a drag mold portion, the cope and drag mold portions having internal walls defining at least in part perimeter boundaries of a coupler knuckle mold cavity;

defining within the internal walls of the mold cavity a finger section to form the entirety of a finger cavity within the coupler knuckle;

positioning a single internal core within either the cope mold portion or the drag mold portion, the single internal core configured to define a kidney cavity and a pivot pin cavity within a coupler knuckle;

closing the cope and drag mold portions with the single core therebetween; and at least partially filling the mold cavity with a molten alloy, the molten alloy solidifying after filling to form the coupler knuckle wherein the single core defines the kidney and pivot pin cavities of the coupler knuckle and the finger section of the mold cavity defines the entirety of the finger cavity of the coupler knuckle.

7. The method of claim 6, wherein the finger section also creates a single, thick rib at a horizontal centerline of the knuckle that passes through the pivot pin cavity, wherein the single, thick rib extends approximately from a flag hole of the finger cavity to an opposite side of the knuckle from the flag hole.

8. The method of claim 7, wherein the single, thick rib comprises dimensions of about 3.0" thick, about 1.7" deep, and about 1.9" long.

9. The method of claim 6, wherein the single core comprises two internal cores, a first for forming the pivot pin cavity and a second for forming the kidney cavity.

* * * * *